US010316626B2

(12) United States Patent
Keshishian et al.

(10) Patent No.: US 10,316,626 B2
(45) Date of Patent: Jun. 11, 2019

(54) BUOYANCY ASSIST TOOL

(71) Applicant: Schlumberger Technology Corporation, Sugar Land, TX (US)

(72) Inventors: Afou Keshishian, Houston, TX (US); Isaac Aviles Cadena, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 49 days.

(21) Appl. No.: 15/153,153

(22) Filed: May 12, 2016

(65) Prior Publication Data

US 2016/0333658 A1 Nov. 17, 2016

Related U.S. Application Data

(60) Provisional application No. 62/162,358, filed on May 15, 2015.

(51) Int. Cl.

| | |
|---|---|
| ***E21B 33/16*** | (2006.01) |
| ***E21B 37/04*** | (2006.01) |
| ***E21B 37/10*** | (2006.01) |
| ***E21B 33/126*** | (2006.01) |
| ***E21B 43/10*** | (2006.01) |

(52) U.S. Cl.

CPC ..... *E21B 43/10* (2013.01); *E21B 33/126* (2013.01); *E21B 33/16* (2013.01); *E21B 37/04* (2013.01); *E21B 37/10* (2013.01)

(58) Field of Classification Search

CPC ..... E21B 33/16; E21B 37/04; E21B 37/10

See application file for complete search history.

(56) References Cited

U.S. PATENT DOCUMENTS

| | | | | |
|---|---|---|---|---|
| 4,986,361 | A * | 1/1991 | Mueller | E21B 7/04 166/381 |
| 5,117,915 | A | 6/1992 | Mueller et al. | |
| 7,669,653 | B2 * | 3/2010 | Craster | E21B 23/06 166/101 |
| 7,775,279 | B2 | 8/2010 | Marya et al. | |
| 8,211,247 | B2 | 7/2012 | Marya et al. | |
| 2014/0224505 | A1 * | 8/2014 | Ramon | E21B 23/01 166/376 |

FOREIGN PATENT DOCUMENTS

WO 2015073001 A1 5/2015

OTHER PUBLICATIONS

Examination Report for corresponding Australian Application No. 2016203183, dated Jun. 22, 2017, 7 pages.

* cited by examiner

*Primary Examiner* — Cathleen R Hutchins

(57) ABSTRACT

A system includes a casing string and a buoyancy assist tool that is disposed in the casing string. The buoyancy assist tool includes a tubular body, a wiper plug assembly, and a degradable member. The wiper plug assembly is disposed inside the central passageway of the tubular body, and the degradable member retains the wiper plug assembly to the tubular body.

15 Claims, 11 Drawing Sheets

BUOYANCY ASSIST TOOL

CROSS-REFERENCE TO RELATED APPLICATIONS

This application claims benefit of U.S. Provisional Patent Application Ser. No. 62/162,358, filed May 15, 2015, which is herein incorporated by reference.

BACKGROUND

Hydrocarbon fluids, such as oil and natural gas, may be obtained from a hydrocarbon-bearing subterranean geologic formation by drilling a well that penetrates the formation. Once a wellbore is drilled, various forms of well completion components may be installed in order to control and enhance the efficiency of producing the fluids.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In accordance with an example implementation, a method includes running a tubing string that includes a tool inside a wellbore. The tool includes a wiper plug assembly and is configured to form a fluid barrier inside a central passageway of the tubing string. The technique includes using a degradable material to secure the wiper plug assembly to a body of the tool; pressurizing the tubing string to breach the fluid barrier; communicating a cement slurry into the tubing string and through the breached fluid barrier; and communicating another plug assembly into the tubing string behind the cement slurry to engage the wiper plug assembly and release the wiper plug assembly from the tool.

In accordance with another example implementation, an apparatus that is usable with a well includes a tubular body, a wiper plug assembly, and a degradable member. The wiper plug assembly is disposed inside the central passageway of the tubular body, and the degradable member retains the wiper plug assembly to the tubular body.

In accordance with another example implementation, a system includes a casing string and a buoyancy assist tool that is disposed in the casing string. The buoyancy assist tool includes a tubular body, a wiper plug assembly, and a degradable member. The wiper plug assembly is disposed inside the central passageway of the tubular body, and the degradable member retains the wiper plug assembly to the tubular body.

In accordance with yet another example implementation, a technique includes running a casing string including a buoyancy assist tool inside a wellbore. The buoyancy assist tool includes a wiper plug assembly retained in place inside the buoyancy assist tool by a degradable sleeve and shear pins attaching the wiper plug assembly to the degradable sleeve; and the wiper plug assembly includes a central passageway that is blocked by a first fluid barrier. The technique includes pressurizing the tubing string to breach the first fluid barrier; communicating a completion fluid downhole inside the casing string to cause the fluid to circulate through the casing string and into an annulus between the casing string and the wellbore; communicating a predetermined volume of a cement into the tubing string; communicating a fluid inside the tubing string following the cement, including communicating a cementing plug assembly to land the cementing plug assembly inside the central passageway of the wiper plug assembly; pressurizing the tubing string to shear the shear pins to cause the wiper plug assembly to be released from the buoyancy assist tool; and using the wiper plug assembly to follow the cement through a central passageway of the casing string until the wiper plug assembly lands in a landing collar of the casing string.

Advantages and other features will become apparent from the following drawings, description and claims.

DETAILED DESCRIPTION

Figure 1:
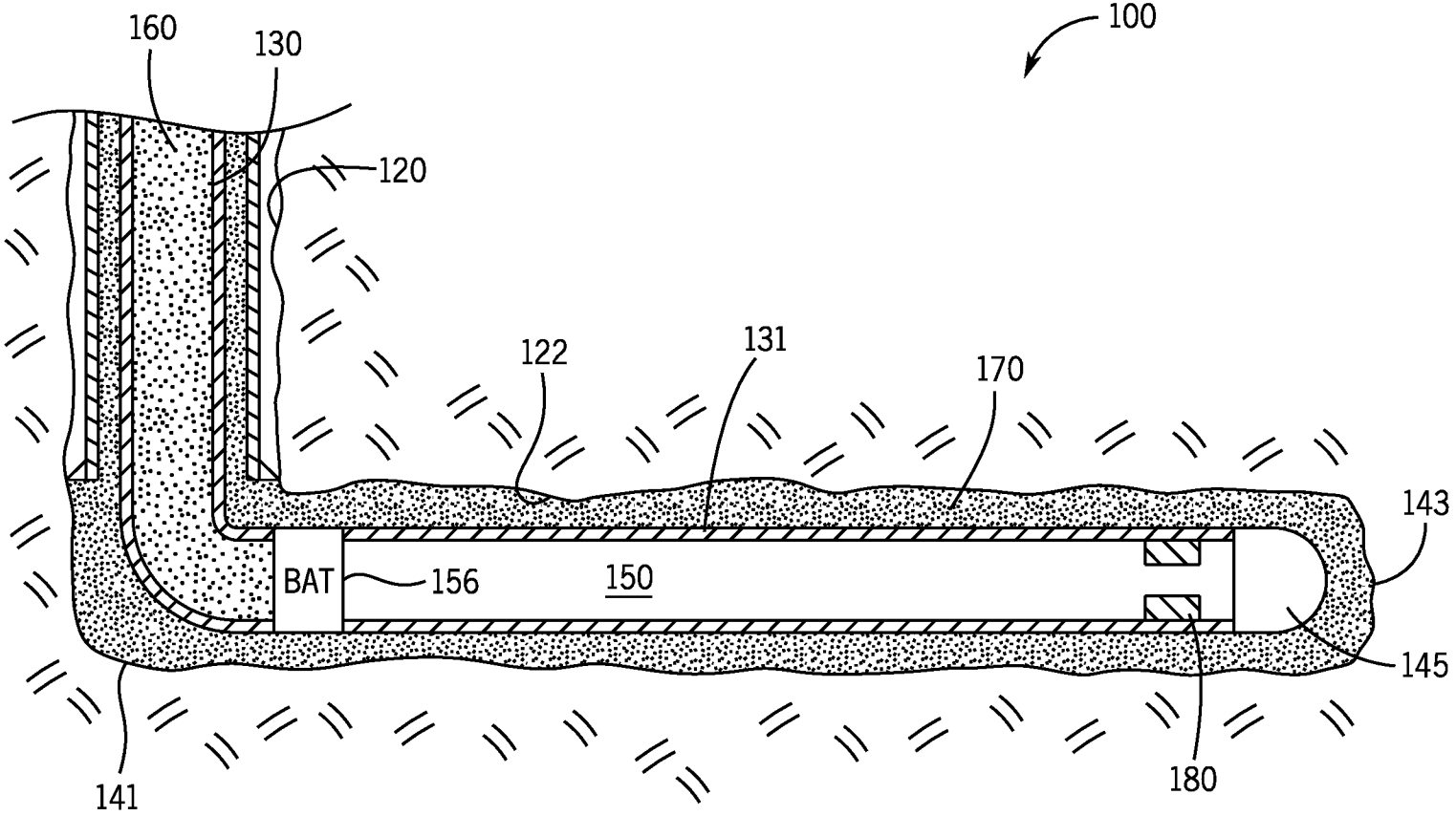
FIGS. 1, 3, 5, and 7 are schematic diagrams of a well illustrating operations related to installing a casing string in a laterally-extending wellbore according to an example implementation.

In the following description, numerous specific details are set forth but implementations may be practiced without these specific details. Well-known circuits, structures and techniques have not been shown in detail to avoid obscuring an understanding of this description. "An implementation," "example implementation," "various implementations" and the like indicate implementation(s) so described may include particular features, structures, or characteristics, but not every implementation necessarily includes the particular features, structures, or characteristics. Some implementations may have some, all, or none of the features described for other implementations. "First", "second", "third" and the like describe a common object and indicate different instances of like objects are being referred to. Such adjectives do not imply objects so described must be in a given sequence, either temporally, spatially, in ranking, or in any other manner. "Coupled" and "connected" and their derivatives are not synonyms. "Connected" may indicate elements are in direct physical or electrical contact with each other and "coupled" may indicate elements co-operate or interact with each other, but they may or may not be in direct physical or electrical contact. Also, while similar or same numbers may be used to designate same or similar parts in different figures, doing so does not mean all figures including similar or same numbers constitute a single or same implementation. Although terms of directional or orientation, such as "up," "down," "upper," "lower," "uphole," "downhole," and the like, may be used herein for purposes of simplifying the discussion of certain implementations, it is understood that these orientations and directions may not be used in accordance with further example implementations.

In accordance with example implementations, casing string may be installed in a horizontal, or laterally extending wellbore, using a buoyancy assist tool. The buoyancy assist tool is part of the casing string and, as its name implies, is used to increase the buoyancy of the casing string during the string's installation. In this manner, the buoyancy assist tool is used to retain air inside a segment of the casing string that is being run into a laterally extending wellbore so that the segment is buoyant, or "floats," and thereby experiences less drag. The buoyancy assist tool may be used to form a fluid barrier at the uphole end of the lateral casing segment, with a cementing float shoe of the lateral casing segment forming a fluid barrier at the downhole end of the segment. The central passageway of the casing string segment is filled with air between these fluid barriers. After being run into the wellbore, a completion fluid may be pressurized in the column above the buoyancy assist tool to remove the fluid barrier imposed by the tool and allow the completion fluid to be circulated through the lateral segment of the casing string and return through the annulus, thereby displacing any drilling fluid (and water above the drilling fluid). A predetermined volume of cement may then be communicated downhole into the central passageway of the casing through the now opened, buoyancy assist tool. The cement may be followed, or chased, by a cementing plug assembly, which is pumped downhole using additional completion fluid. The cementing plug assembly lands in a passageway of a liner wiper plug assembly, which is initially retained inside the buoyancy assist tool. The landed cementing plug assembly forms a fluid barrier inside the casing string; and by pressuring the completion fluid (using this fluid barrier), the wiper plug assembly is released from the tool. After being released, the wiper plug assembly may then travel downhole due to the pumping of the completion fluid to swab the inside of the lateral casing string segment and aid in displacing the cement into the surrounding annulus. At the far, or distal, end (i.e., the toe end) of the casing segment, the wiper plug assembly lands in a landing collar that is disposed near the float shoe near the end of the lateral casing segment.

One way to initially secure the wiper plug assembly to a buoyancy assist tool is to use shear pins that extend between a tubular body of the assembly and into the tubular body of the tool, which forms part of the casing string wall. In this manner, by plugging the wiper plug assembly with the cementing plug assembly and pressuring the column of completion fluid above the wiper plug assembly, the shear pins shear to release the wiper plug assembly. A particular challenge associated with retaining the wiper plug assembly to the buoyancy assist tool in the above-described manner is that the outer diameter (O.D.) of the wiper plug assembly is close in size to the inner diameter (I.D.) of the buoyancy tool's tubular body. This relationship, in turn, constrains the I.D. of any component of the casing string downhole from the buoyancy assist tool to be near the I.D. of the buoyancy tool's tubular body.

In accordance with example implementations that are described herein, the buoyancy assist tool retains a wiper plug assembly in a manner that allows the wiper plug assembly to have a decreased O.D., as compared to conventional buoyancy assist tools. Consequently, components of the casing string that are disposed downhole from the buoyancy assist tool may have relatively smaller IDs. More specifically, in accordance with example implementations, the buoyancy assist tool includes a degradable member to which the wiper plug assembly is initially secured (by one or multiple shear pins, for example). The degradable member, in accordance with example implementations, is a degradable sleeve that circumscribes the wiper plug assembly and is retained inside a tubular body of the buoyancy assist tool. The annular space that is occupied by the degradable sleeve allows the wiper plug assembly to have a reduced OD, thereby resulting in reduced IDs for components of the casing string downhole of the buoyancy assist tool.

When the column of completion fluid is pressurized uphole of the buoyancy assist tool to release the wiper plug assembly from the buoyancy assist tool, the shear member(s) shear, thereby leaving the degradable sleeve in place inside the buoyancy assist tool. The degradable member is constructed to deteriorate, dissolve, or degrade, in a relatively short interval of time (a time of a few weeks or a few months, depending on the particular implementation). Therefore, the space inside the body of the buoyancy assist tool increases with the removal of the degradable sleeve, and moreover, the degrading of the sleeve leaves little to no debris in the lateral casing segment, in accordance with example implementations.

Referring to FIG. 1, as a more specific example, a well 100 may include a laterally extending wellbore 122, which may, extend from a relatively more vertically extending wellbore 120 of the well 100. The laterally extending wellbore segment 122 may traverse one or more hydrocarbon-bearing formations. FIG. 1 depicts the initial installation of a casing string 130, a tubing string inside the well, and more specifically, the casing string 130 has a segment 131 that extends into the laterally extending wellbore 122. In this state, an annulus 170 of the casing string segment 131 is surrounded by drilling fluid, and water may be present above the drilling fluid. As depicted in FIG. 1, the lateral casing string segment 131 extends from a heel end 141 to a toe end 143 of the laterally extending wellbore 122, in accordance with example implementations.

For purposes of cementing the lateral casing string segment 131 in place inside the laterally extending wellbore 122, the casing string 130 includes a buoyancy assist tool 156, which is disposed near the heel end 141 of the wellbore 122 after the casing string segment 122 has been run into position. The buoyancy assist tool 156 is run downhole in a state in which the tool 156 initially blocks fluid communication through the central passageway of the lateral casing string segment 131. In other words, initially, the buoyancy assist tool 156 forms a fluid obstruction, or barrier, inside a central passageway 150 of the casing string 130, so that the casing string segment 131 downhole of the buoyancy assist tool 156 is isolated from the central passageway of the tubing string uphole of the tool 156 (and a column of completion fluid 160 uphole of the tool 156, for example). Moreover, a cementing float shoe, a one way valve, maintains the isolation at the downhole end of the casing string segment 131. Due to this isolation, the interior space of the casing string segment 131 is kept free of the drilling fluid and other liquids during the running of the casing string 130 downhole, which facilitates installation of the string due to the string's increased buoyancy and lowered weight.

In accordance with example implementations, the casing string segment 131 may be initially filled with air or another gas. As depicted in FIG. 1, the casing string 130 may further includes a landing collar 180, which is used, as further described herein.

It is noted that although FIG. 1 and other figures that are described herein depict a laterally extending wellbore, the techniques and systems that are disclosed herein may likewise be applied to more vertically extending wellbores. Moreover, in accordance with example implementations, the well 100 may contain multiple wellbores, which contain tubing strings that are similar to the illustrated tubing string 130 of FIG. 1. The well 100 may be a subsea well or may be a terrestrial well, depending on the particular implementation. Additionally, the well 100 may be an injection well or may be a production well. Thus, many implementations are contemplated, which are within the scope of the appended claims.

Figure 2:
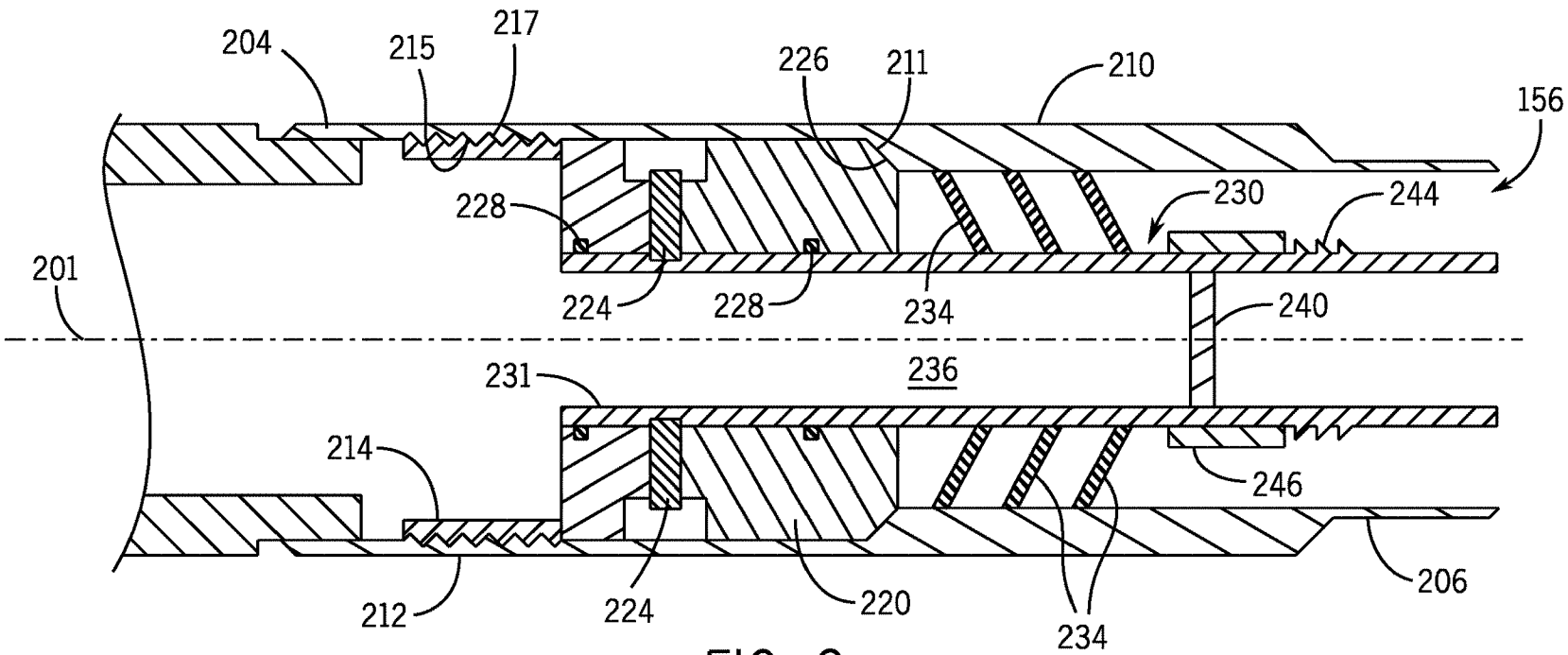
FIGS. 2, 4, 6, 8 and 9 are cross-sectional views of a buoyancy assist tool of the casing string in different states associated with the installation of the casing string according to an example implementation.

FIG. 2 depicts the buoyancy assist tool 156, in accordance with an example implementation. In particular, FIG. 2 depicts the buoyancy assist tool 156 in its initial, or run-in hole, state. Referring to FIG. 2 in conjunction with FIG. 1, the buoyancy assist tool 156 includes a tubular housing, or body 210, which, in general, circumscribes a longitudinal axis 201 of the tool 156 (and nearby portion of the lateral casing string segment 131). As depicted in FIG. 2, in its run-in hole state, the buoyancy assist tool 156 includes a liner wiper plug assembly 230, which is disposed inside a central passageway of the tool 156. Moreover, in the run-in hole state of the buoyancy assist tool 156, the wiper plug assembly 230 is secured in place by a degradable sleeve 220 (that circumscribes a tubular member 231 of the wiper plug assembly 230) and one or multiple shear pins 224 that attach the tubular member 231 to the sleeve 220.

More particularly, in accordance with example implementations, the degradable sleeve 220 circumscribes the longitudinal axis 201 and is circumscribed by the body 210 of the buoyancy assist tool 156. As an example, the body 210 may form part of the wall of the casing string 130. In accordance with some implementations, the degradable sleeve 220 rests in a restriction that is formed inside the tubular body 210 by an uphole and inwardly facing inclined annular surface 211 of the tubular body 210. In this manner, as shown in FIG. 2, a corresponding downhole and outwardly facing inclined annular surface 226 of the degradable sleeve 220 may contact the surface 211. On its uphole end, the degradable sleeve 220 may be held in place inside the tubular body 210 by a retaining device, such as a lock ring 214. As an example, the lock ring 214 may be installed inside the tubular body 210 and have outer threads 215 that engage corresponding inner threads 217 of the tubular body 210, in accordance with example implementations. As also shown in FIG. 2, in accordance with some implementations, the tubular member 231 of the wiper plug assembly 230 may be secured to the degradable sleeve 220 by one or multiple shear pins 224, thereby initially securing the wiper plug assembly 230 inside the buoyancy assist tool 156.

In general, the wiper plug assembly 230 has swabbing wipers, or cups 234 (rubber or elastomer cups, for example) that annularly extend about the tubular member 231 for purposes of swabbing the interior surface of the lateral casing string segment 131 after the wiper plug assembly 230 has been released from the buoyancy assist tool 156, as further described below. The wiper plug assembly 230 forms an interior fluid barrier inside the buoyancy assist tool 156, which inhibits, or prevents, fluid communication through the wiper plug assembly 230 for purposes of initially created the air filled zone in the lateral casing string segment 131. In this manner, in the run-in-hole states of the buoyancy assist tool 156, the outer swabbing cups 234 may be energized to form an annular fluid seal between the tubing member 231 and the tubular body 210; one or multiple o-rings 228 may form fluid seals between the tubing member 231 and the degradable sleeve 220; and a removable fluid barrier 240 prevents fluid communication through the central passageway of the tubular member 231 of the wiper plug assembly 230. In accordance with example implementations, the fluid barrier inside the tubing member 231 may be formed from a rupture disc, which is constructed to rupture at a pressure above a certain threshold, which allows a pressurized fluid column above the buoyancy assist tool 156 to be used to remove the initial fluid barrier that is created by the tool 136, so that completion fluid may be circulated through the central passageway of the lateral casing string segment 131 and into the surrounding annulus 170.

Among its other features, the buoyancy assist tool 156 may include couplers to couple, or connect, the buoyancy assist tool 156 in line with the casing string 130. For example, in accordance with some implementations, the buoyancy assist tool 156 may include a box end coupler 204 at its far uphole end and a pin end coupler 206 at its far downhole end. Other connectors may be used to couple the buoyancy assist tool 156 in line with the casing string 130, in accordance with further example implementations.

As also depicted in FIG. 2, in accordance with some implementations, the wiper plug assembly 230 may include outer ratcheting teeth 244 near the downhole end of the tubing member 231 to lock the assembly 230 in place after landing in the landing collar 180. Moreover, as shown in FIG. 2, uphole form the ratcheting teeth 244, the wiper plug assembly 230 may include a stop collar 246, which circumscribes the tubing member 231 for purposes for purposes of limiting downhole travel of the wiper plug assembly 230 into the landing collar 180.

Figure 3:
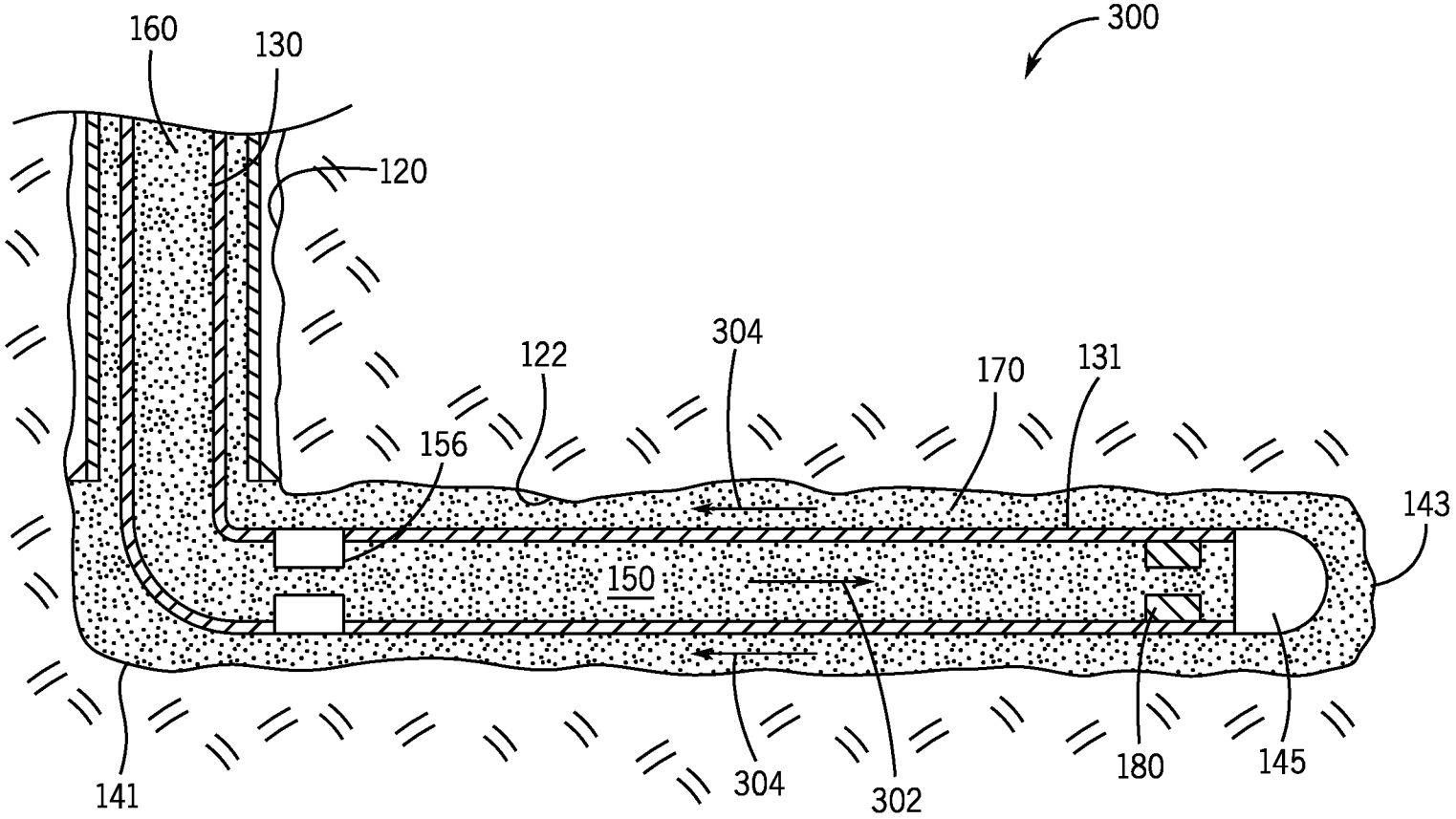
Figure 4:
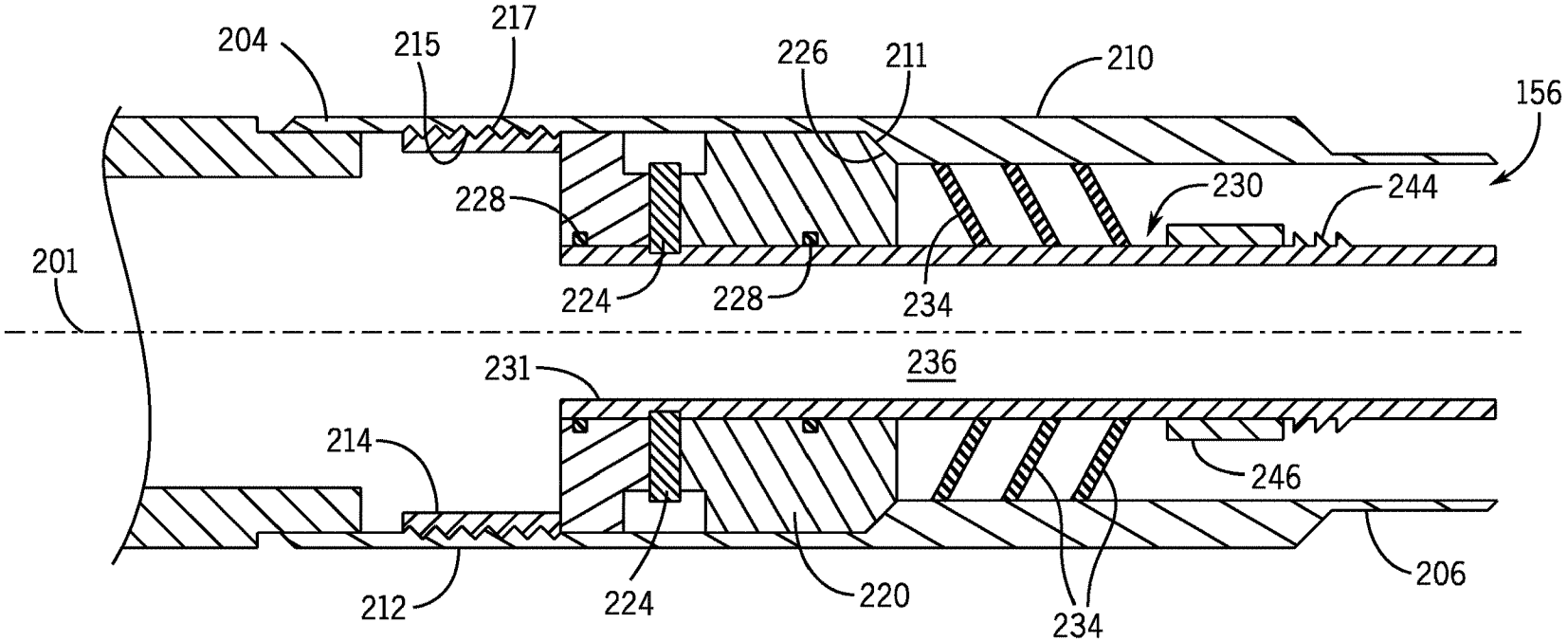

FIG. 3 depicts an illustration 300 of the well after completion fluid 160 has been pumped into the casing string 130 such that the fluid column above the buoyancy assist tool 156 has been pressurized above the rupturing threshold of the rupture disc 240 (FIG. 2). In this manner, referring to FIG. 4 in conjunction with FIG. 3, the pressurized fluid opens, or ruptures, the rupture disc 240 to allow fluid communication through central passageway of the tubing member 231 (i.e., allow fluid communication through the buoyancy assist tool 156). The completion fluid may then be circulated through the float shoe 182 of the casing string 130 and into the annulus 170, as depicted by arrows 302 and 304 in FIG. 3. It is noted that the wiper plug assembly 230, for this state, remains inside the buoyancy assist tool 156.

Figure 5:
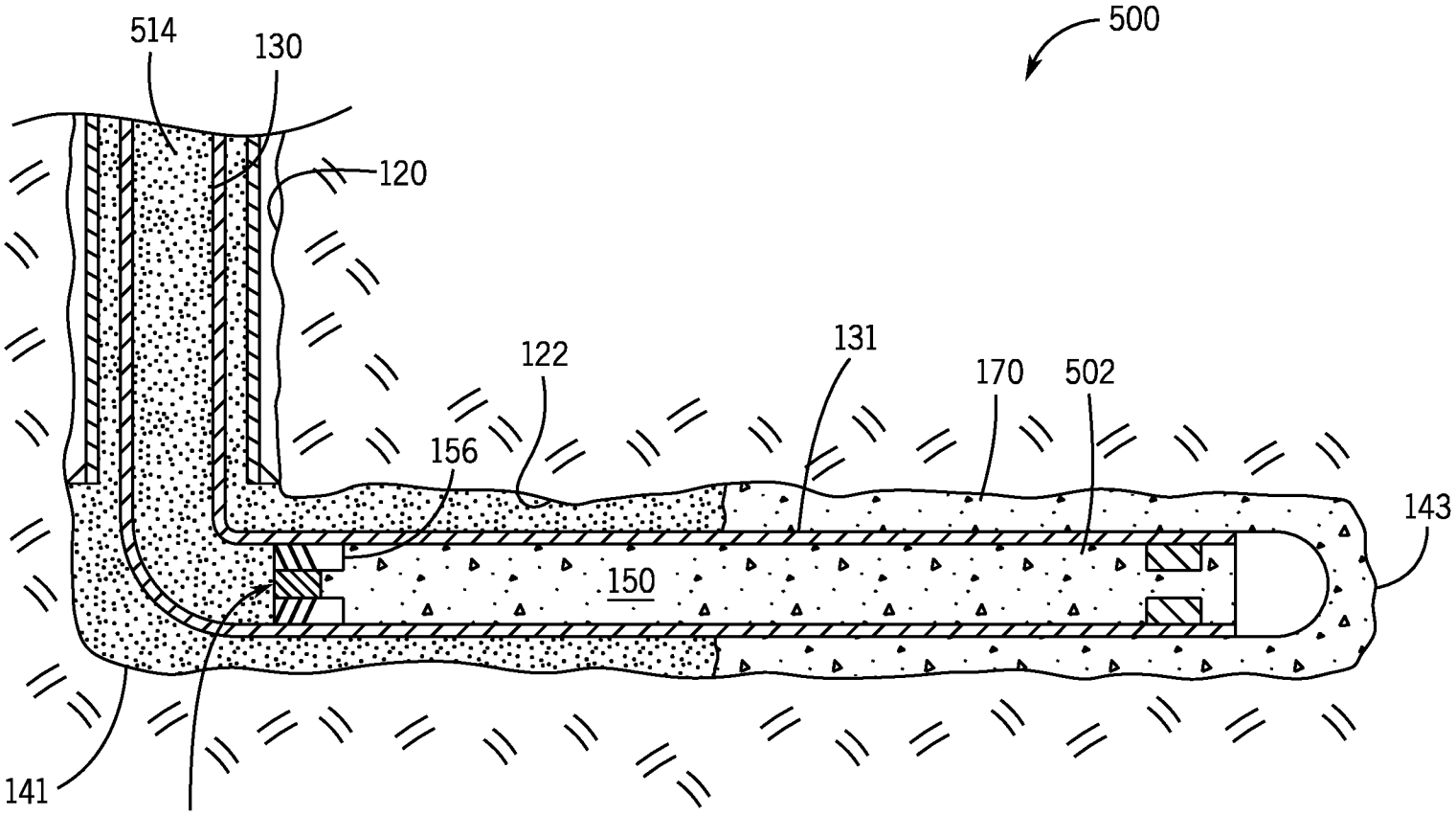
Figure 6:
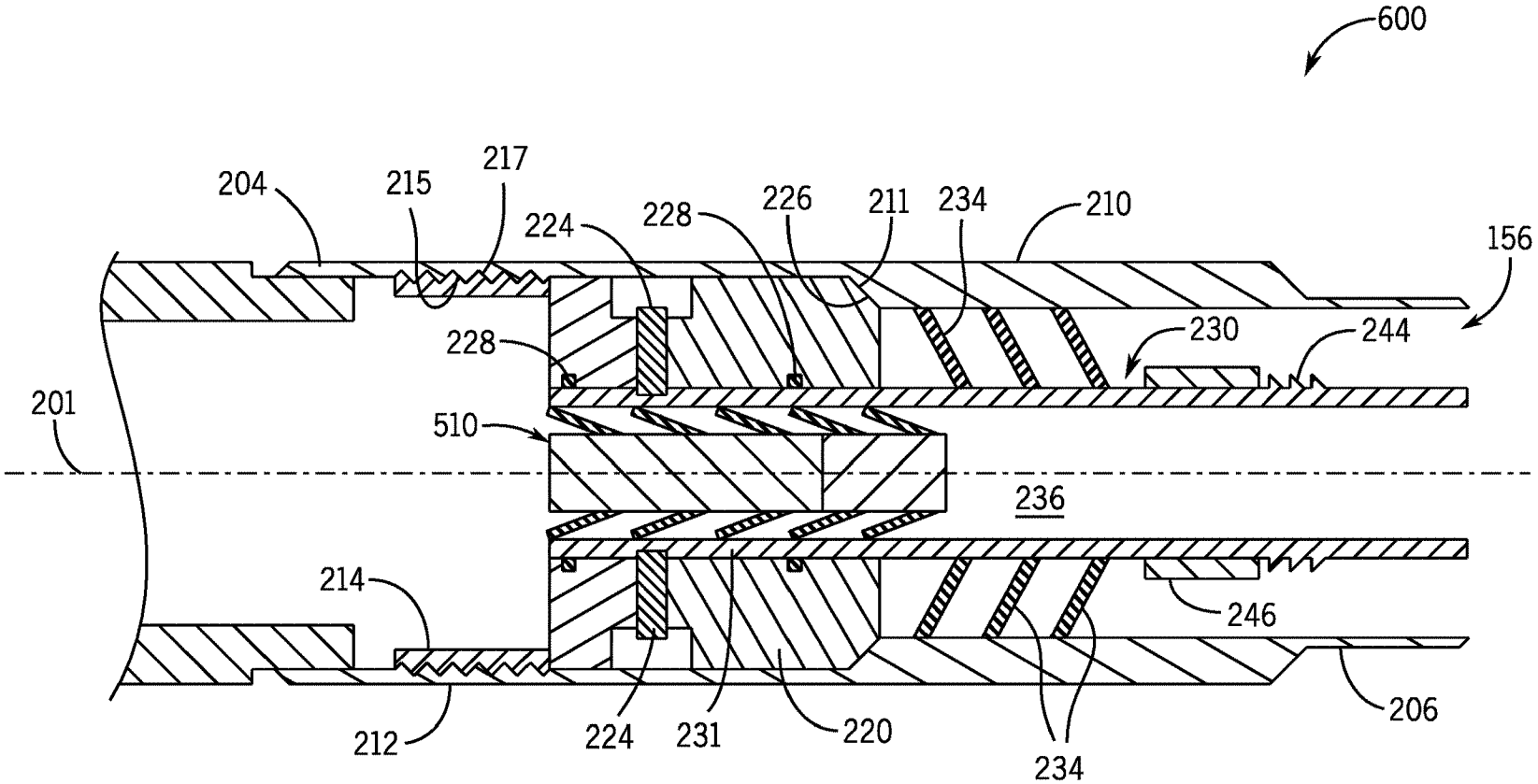
Figure 7:
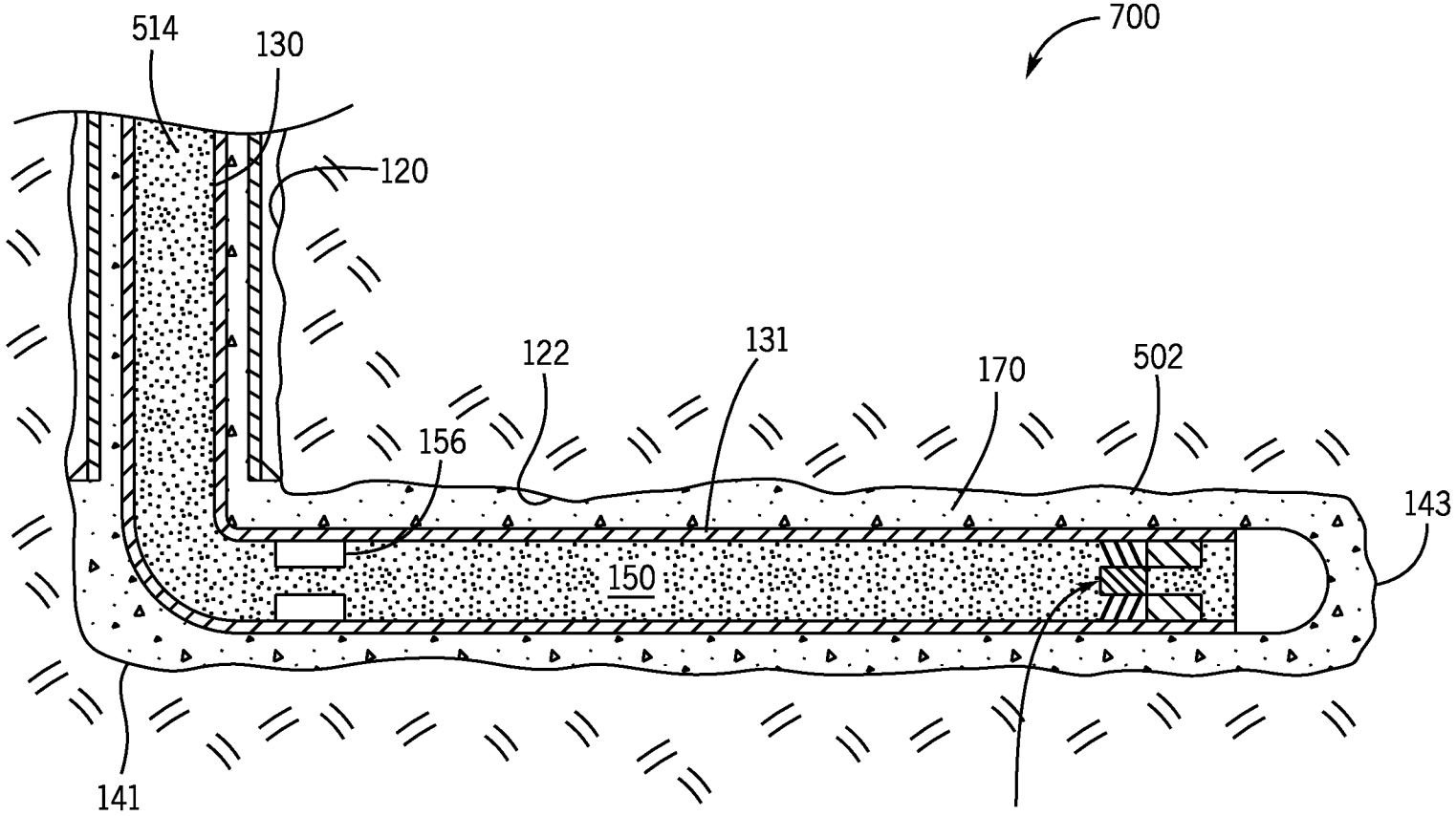
Figure 8:
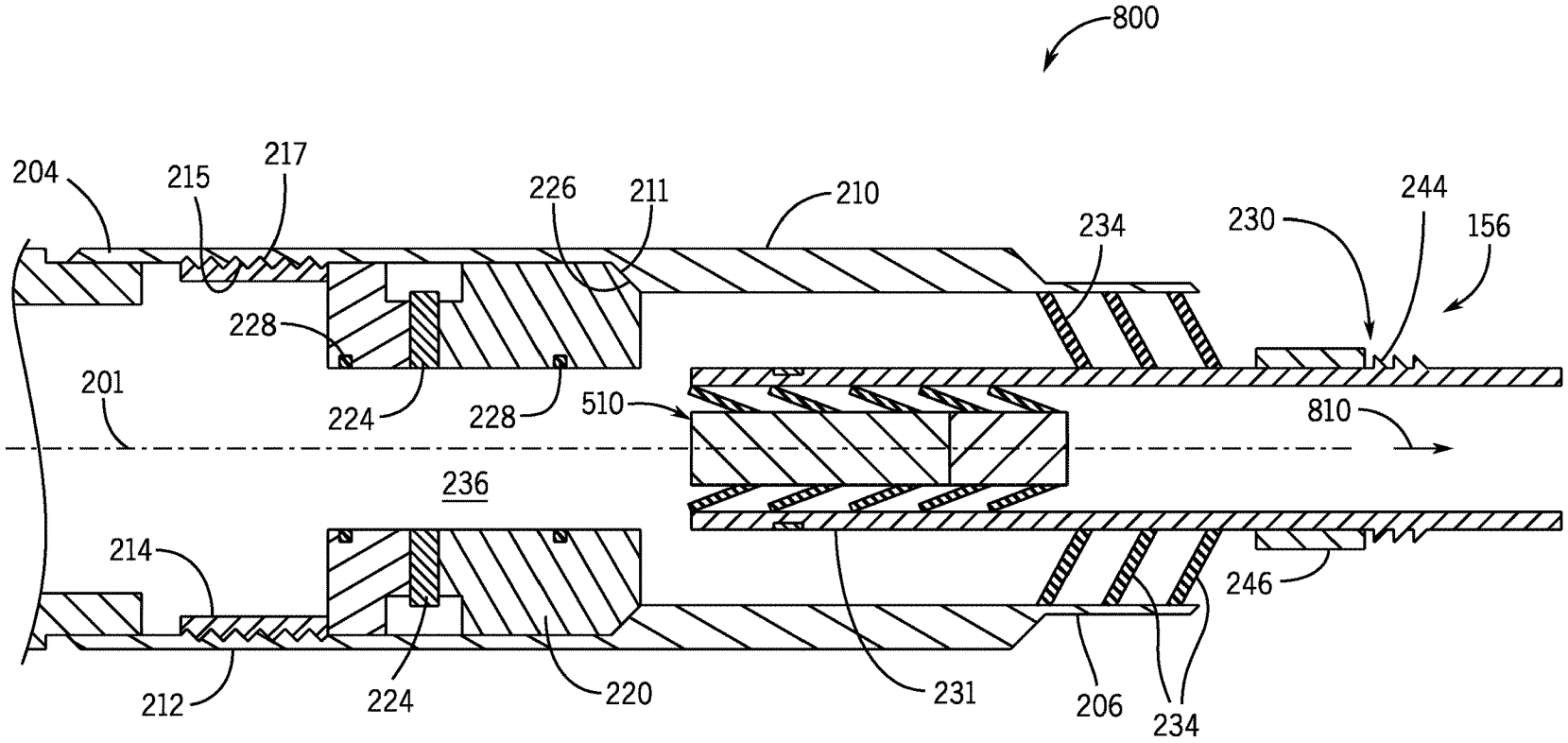

Referring to FIG. 5 (an illustration 500 of the next state of the well 100) and FIG. 6 (an illustration 600 of the corresponding state of the buoyancy assist tool 156), a predetermined volume of cement 502 (FIG. 5) may be communicated downhole through the central passageway of the casing string 130, and the pumping of the cement 502 may be followed, or chased, by a cementing plug assembly 510, which, in turn, is followed by a column of completion fluid (as depicted at reference numeral 514 of FIG. 5). The plug assembly 510 enters the inner tubing member 231 of the plug assembly 230 for purposes of forming a corresponding fluid barrier inside the tubing member 231. By increasing the pressure of the completion fluid column on the buoyancy assist tool 156, an axial force is exerted on the tool 156 to cause the shear pin(s) 224 to shear, thereby releasing the wiper plug assembly 230 from the buoyancy assist tool 156, as depicted by an illustration 800 of FIG. 8. In this manner, the wiper plug assembly 230 exits the buoyancy assist tool 156 and travels in a downhole direction 810 as shown in FIG. 8. Referring to an illustration 700 in FIG. 7 showing the landing of the wiper plug assembly 230 in the landing collar 180, for this state, the cement has been displaced in the annulus 170, thereby completing the cementing operation.

Figure 9:
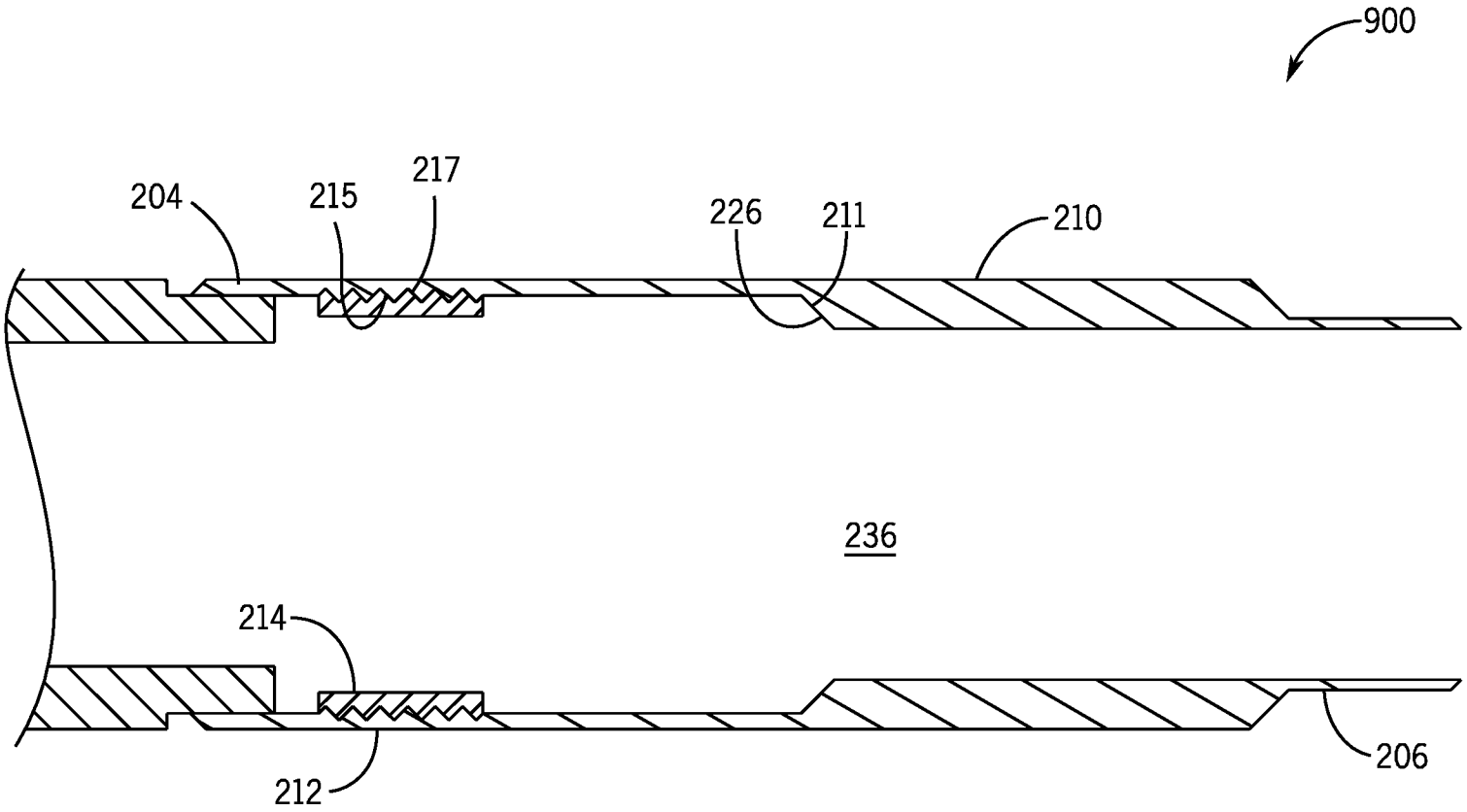

Referring back to FIG. 8, after the wiper plug assembly exits the buoyancy assist tool 156, the degradable sleeve 220 remains. After a relatively short interval of time (a few weeks, or months, depending on the particular implementation), the degradable material degrades to the extent that the degradable sleeve 220 falls, or is otherwise removed from the buoyancy assist tool 156, as depicted in illustration 900 of FIG. 9.

In accordance with example implementations, one or more components of the buoyancy assist tool 156 (such as the degradable sleeve 220) may contain a material or materials, which allow at least part of the object to degrade (dissolve, structurally deteriorate, and so forth) by well fluid or another fluid, which is introduced into the tubing string passageway. As an example, the material(s) for the object may be the same or similar to the materials disclosed in the following patents, which have an assignee in common with the present application and are hereby each incorporated by reference: U.S. Pat. No. 7,775,279, entitled, "DEBRIS-FREE PERFORATING APPARATUS AND TECHNIQUE," which issued on Aug. 17, 2010; and U.S. Pat. No. 8,211,247, entitled, "DEGRADABLE COMPOSITIONS, APPARATUS COMPOSITIONS COMPRISING SAME, AND METHOD OF USE," which issued on Jul. 3, 2012.

In this context, a degradable material is a material that degrades at a significantly faster rate than other materials or components (the casing string 130, for example) of the downhole well equipment. For example, in accordance with some implementations, dissolvable or degradable material(s) may degrade at sufficiently fast rate to allow the fluid barrier to disappear (due to the material degradation) after a relatively short period of time (a period less than one year, a period less than six months, or a period of less than ten weeks, as just a few examples). In this manner, in accordance with example implementations, the degradable sleeve of the buoyancy assist tool maintains its structural integrity for a sufficient time to allow the cementing operation(s) that rely on the buoyancy assist tool 156 to be performed, while disappearing shortly thereafter to remove any obstruction presented by the member to allow other operations to proceed in the well, which rely on access through the portion of the casing string, which contained the fluid barrier.

Figure 10:
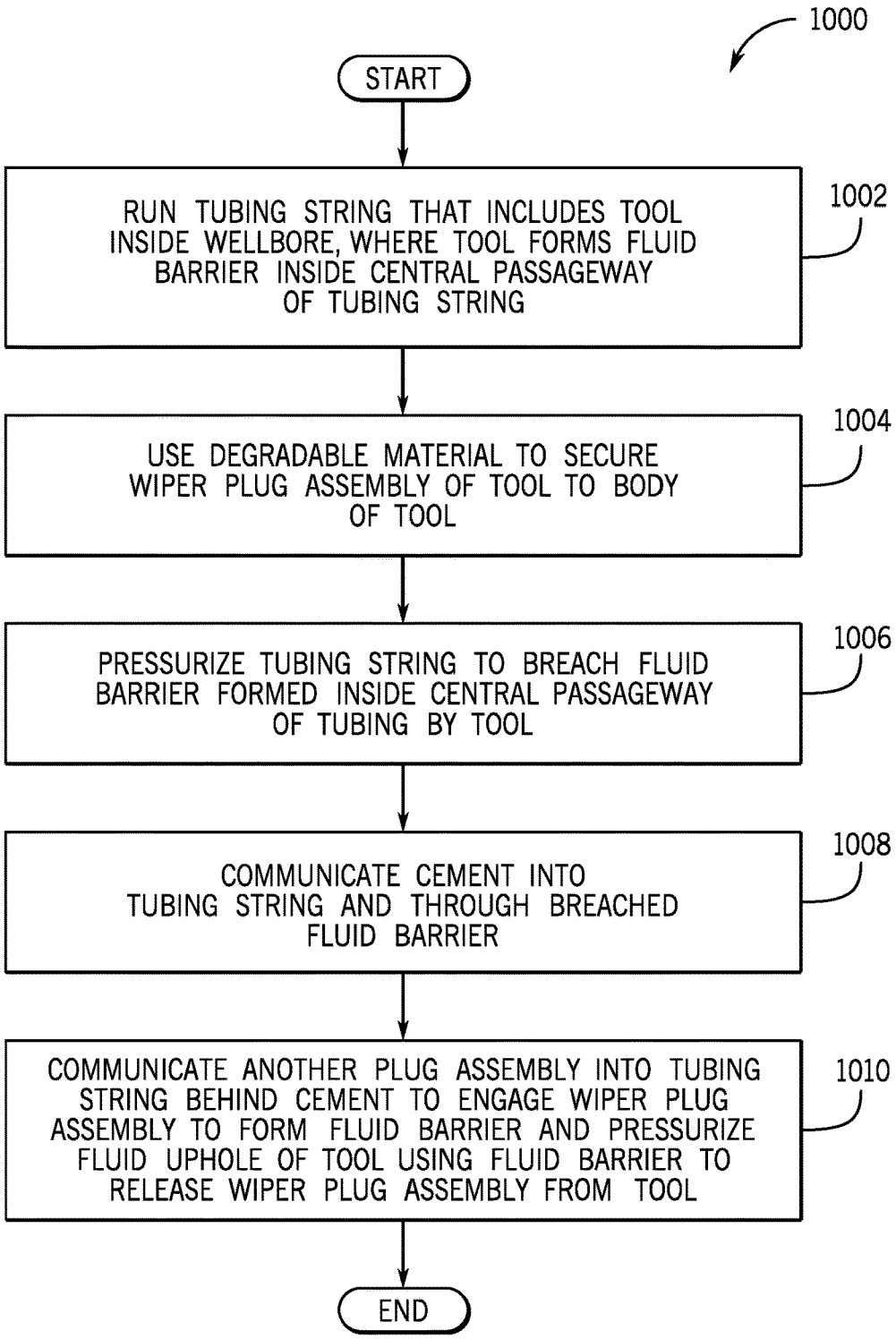
FIGS. 10 and 11 are flow diagrams depicting techniques to install a casing string in a well according to example implementations.

Thus, in general, a technique 1000 (FIG. 10) may be performed in accordance with example implementations. Pursuant to the technique 1000 a tubing string is run (block 1002) inside a wellbore, where the tool forms fluid barrier inside central passageway of the tubing string. Pursuant to block 1004, a degradable material is used to secure a wiper plug assembly of the tool to a body of the tool. The tubing string may be pressurized (block 1006) to breach a fluid barrier that is formed inside a central passageway of the tubing string by the tool. Cement may then be communicated (block 1008) into the tubing string and through the breached, fluid barrier. Another plug assembly may then be communicated into the tubing string behind the cement slurry to engage the wiper plug assembly to form a fluid barrier, and fluid uphole of the tool may be pressurized using the fluid barrier to release the wiper plug assembly from the tool, pursuant to block 1010.

Figure 11:
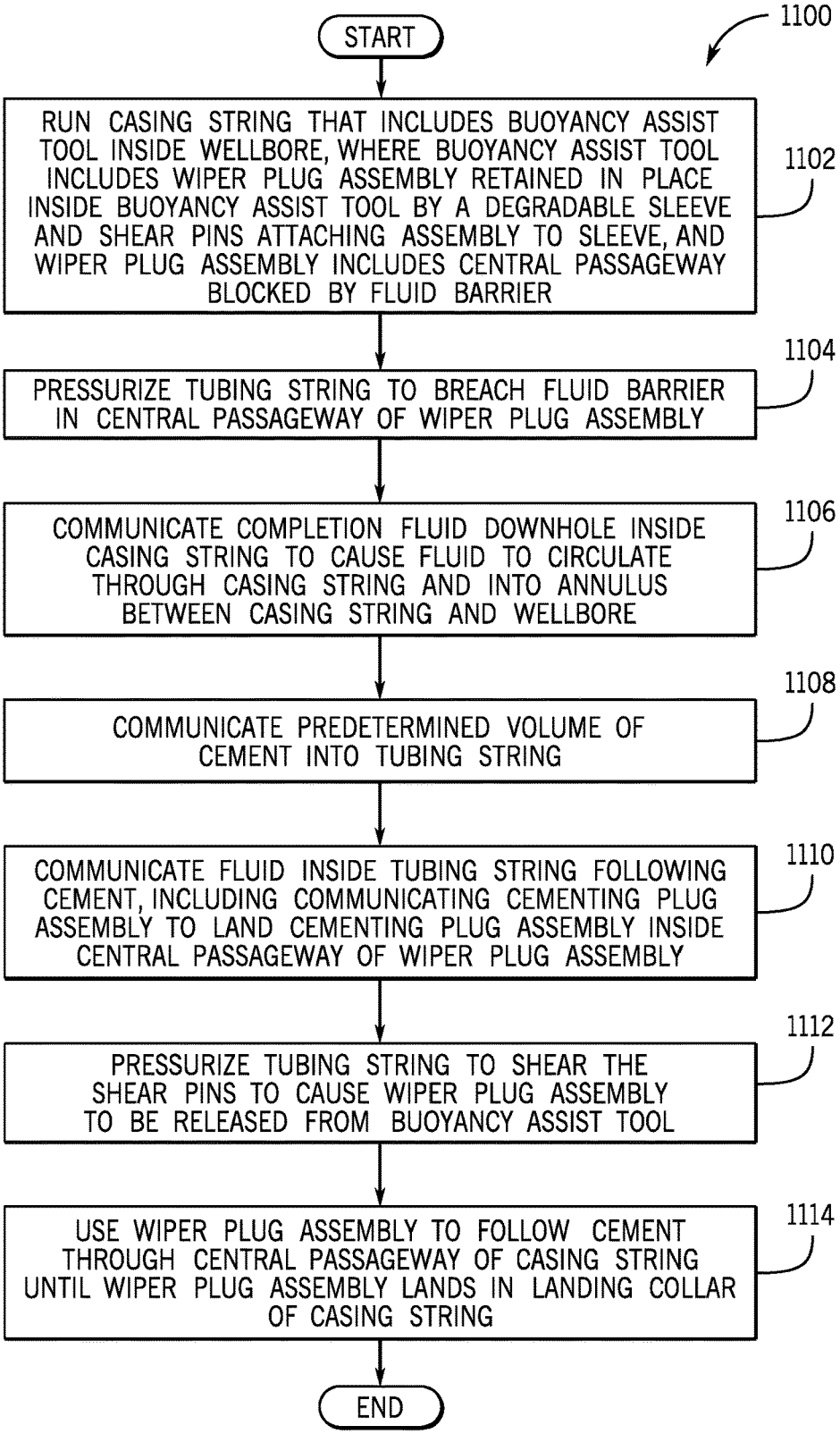

More specifically, referring to FIG. 11, in accordance with some implementations, a technique 1100 includes running (block 1102) a casing string that includes a buoyancy assist tool inside a wellbore. The buoyancy assist tool includes a wiper plug assembly that is retained in place inside the buoyancy assist tool by a degradable sleeve and shear pins that attach the assembly to the sleeve; and the wiper plug assembly includes a central passageway that is initially blocked by the fluid barrier. Pursuant to block 1104, the tubing string may then be pressurized to breach the fluid barrier in the central passageway. Completion fluid may then be communicated (block 1106) downhole inside the casing string to cause the fluid to circulate through the casing string and into the annulus between the casing string and the wellbore. A predetermined volume of cement may then be communicated into the casing string, pursuant to block 1108. The technique 1100 next includes communicating (block 1110) fluid inside the casing string following the cement, including communicating a cementing plug assembly to land the cementing plug assembly inside a central passageway of the wiper plug assembly. The tubing string may then be pressurized (block 1112) to shear the shear pins to cause the wiper plug assembly to be released from the buoyancy assist tool. The wiper assembly is then used (block 1114) to follow the cement through the central passageway of the casing string until the wiper plug assembly lands in a landing collar of the casing string.

While the present techniques have been described with respect to a number of embodiments, it will be appreciated that numerous modifications and variations may be applicable therefrom. It is intended that the appended claims cover all such modifications and variations as fall within the scope of the present techniques.

What is claimed is:

1. A method comprising:

running a tubing string comprising a tool inside a wellbore, the tool comprising a wiper plug assembly disposed within a body of the tool, the tool being configured to form a fluid barrier inside a central passageway of the tubing string;

providing the wiper plug assembly with a tubular member having a diameter selected to establish an annular space between the tubular member and the body;

using a degradable material extending radially inward from the body to the tubular member so as to sealably secure the wiper plug assembly to the body of the tool;

pressurizing the tubing string to breach the fluid barrier;

communicating a cement slurry into the tubing string and through the breached fluid barrier;

communicating another plug assembly into the tubing string behind the cement slurry;

chasing the other plug assembly with a completion fluid column until the other plug assembly enters and is fully enclosed within a central passageway of the tubular member of the wiper plug assembly; and increasing pressure of the completion fluid column against the tool to release the wiper plug assembly and the other plug assembly from the degradable material and thus from the tool while leaving at least a portion of the degradable material in the tool for subsequent degradation.

2. The method of claim 1, wherein using the degradable material to secure the wiper plug assembly to the body of the tool comprises:

forming the degradable material into a degradable member of a desired shape to secure the wiper plug assembly;

retaining the degradable member inside the body, the degradable member being radially disposed between the wiper plug assembly and the body; and securing the wiper plug assembly to the degradable member using at least one shear member.

3. The method of claim 2, wherein retaining the degradable member inside the body comprises:

securing the degradable member against a restriction formed in the body.

4. The method of claim 1, further comprising:

following the cement slurry with the released wiper plug assembly; and landing the released wiper plug assembly in a landing collar of the tubing string.

5. A system comprising:

a casing string; and a buoyancy assist tool disposed in the casing string, the buoyancy assist tool comprising:

a tubular body comprising a central passageway;

a wiper plug assembly disposed inside the central passageway of the tubular body, the wiper plug assembly having a tubular member with a diameter selected to establish an annular space between the tubular member and the tubular body;

a cementing plug assembly for entering and being fully enclosed within a central passageway of the tubular member of the wiper plug assembly, the cementing plug assembly entering the casing string following a cement slurry through the central passageway, and being followed by a column of completion fluid; and a degradable material in the form of an annular member to retain the wiper plug assembly to the tubular body, the annular member positioning the tubular member to maintain the annular space while enabling a seal between the tubular member and the tubular body.

6. The system of claim 5, wherein the casing string further comprises:

a landing collar to receive the wiper plug assembly after the wiper plug assembly is released from the tubular body of the buoyancy assist tool.

7. The system of claim 5, further comprising:

a shear member to releasably secure the wiper plug assembly to the degradable member.

8. The system of claim 7, wherein the shear member releasably secures the tubular member of the wiper plug assembly to the degradable member.

9. The system of claim 5, wherein the wiper plug assembly comprises a tubing comprising a central passageway, the apparatus further comprising:

a removable fluid barrier to block fluid communication through the central passageway of the wiper plug assembly.

10. The system of claim 9, wherein the removable fluid barrier comprises a rupture disc.

11. The system of claim 5, wherein the tubular body comprises a restriction, and the degradable member has an outer dimension to cause the degradable member to be retained by the restriction.

12. The system of claim 11, wherein the restriction is disposed on a first axial end of the degradable member, the apparatus further comprising a locking ring disposed on a second axial end of the degradable member, the locking ring adapted to form a connection with the tubular body.

13. The system of claim 5, further comprising connectors to couple the tubular body to a tubing string.

14. A method comprising:

running a casing string comprising a buoyancy assist tool inside a wellbore, wherein the buoyancy assist tool comprises a wiper plug assembly retained in place inside the buoyancy assist tool by a degradable sleeve and shear pins attaching the wiper plug assembly to the degradable sleeve, and the wiper plug assembly comprising a tubular member having a central passageway blocked by a first fluid barrier;

pressurizing the tubing string to breach the first fluid barrier;

communicating a completion fluid downhole inside the casing string to cause the fluid to circulate through the casing string and into an annulus between the casing string and the wellbore;

communicating a predetermined volume of a cement into the tubing string;

communicating a completion fluid column inside the tubing string following the cement, including communicating a cementing plug assembly to land inside and be fully enclosed within the central passageway of the tubular member of the wiper plug assembly;

pressurizing the tubing string to shear the shear pins to cause the wiper plug assembly and the cementing plug assembly to be released from the degradable sleeve;

allowing at least a portion of the degradable sleeve to remain in the buoyancy assist tool for subsequent degradation; and using the wiper plug assembly with the cementing plug assembly fully enclosed therein to follow the cement through a central passageway of the casing string until the wiper plug assembly with the cementing plug assembly lands in a landing collar of the casing string.

15. The method of claim 14, further comprising:

running equipment through the buoyancy assist tool, comprising allowing the degradable sleeve to degrade and be removed from the buoyancy assist tool.

* * * * *